US005855305A

United States Patent [19]

Nichols

[11] Patent Number: 5,855,305

[45] Date of Patent: Jan. 5, 1999

[54] HOLSTER WITH TRIGGER GUARD RETENTION DEVICE

[76] Inventor: Richard E. D. Nichols, 13223 Black Mountain Rd., #357, San Diego, Calif. 92129

[21] Appl. No.: 721,572

[22] Filed: Oct. 1, 1996

[51] Int. Cl.[6] ..... F41C 33/02

[52] U.S. Cl. ..... 224/244; 224/911

[58] Field of Search ..... 224/244, 243, 224/193, 911

[56] References Cited

U.S. PATENT DOCUMENTS

| | | |
|---|---|---|
| 609,317 | 8/1898 | Zimmerman . |
| 1,113,530 | 10/1914 | Audley . |
| 1,421,578 | 7/1922 | Schussler . |
| 1,635,984 | 7/1927 | Corriston . |
| 1,641,439 | 9/1927 | Jovino . |
| 1,851,352 | 3/1932 | Denkert . |
| 1,876,613 | 9/1932 | Clark . |
| 1,930,203 | 10/1933 | Jewett . |
| 1,951,865 | 3/1934 | Franz . |
| 2,001,321 | 5/1935 | Berns . |
| 2,109,734 | 3/1938 | Preneta . |
| 2,349,376 | 5/1944 | Ray . |
| 2,551,913 | 5/1951 | Toby . |
| 2,893,615 | 7/1959 | Couper . |
| 3,008,617 | 11/1961 | Villwock . |
| 3,531,031 | 9/1970 | Angell . |
| 3,630,420 | 12/1971 | Bianchi . |
| 3,645,428 | 2/1972 | Angell . |
| 3,669,325 | 6/1972 | Furman . |
| 3,718,240 | 2/1973 | Rose . |
| 3,777,952 | 12/1973 | Theodore . |
| 3,828,990 | 8/1974 | Baldocchi . |
| 3,866,811 | 2/1975 | Hamby . |
| 3,942,692 | 3/1976 | Chica . |
| 3,977,583 | 8/1976 | Bianchi et al. . |
| 4,055,015 | 10/1977 | Musgrave . |
| 4,256,243 | 3/1981 | Bianchi et al. . |
| 4,277,007 | 7/1981 | Bianchi et al. . |
| 4,298,150 | 11/1981 | Seldeen . |
| 4,318,503 | 3/1982 | Capano . |
| 4,542,841 | 9/1985 | Bianchi et al. . |
| 4,694,980 | 9/1987 | Rogers . |
| 4,846,384 | 7/1989 | Perry . |
| 4,865,238 | 9/1989 | Bianchi . |
| 4,925,075 | 5/1990 | Rogers . |
| 4,934,574 | 6/1990 | Salandre . |
| 5,018,654 | 5/1991 | Rogers et al. . |
| 5,048,735 | 9/1991 | McCormick . |
| 5,094,376 | 3/1992 | Baruch . |
| 5,100,036 | 3/1992 | Rogers et al. . |
| 5,129,562 | 7/1992 | Bianchi . |
| 5,275,317 | 1/1994 | Rogers et al. . |
| 5,372,288 | 12/1994 | Rogers et al. . |
| 5,395,021 | 3/1995 | Brown . |
| 5,419,474 | 5/1995 | Marx et al. . |
| 5,421,497 | 6/1995 | Gilmore . |
| 5,449,103 | 9/1995 | Tilley . |
| 5,467,909 | 11/1995 | Resca et al. . |
| 5,509,591 | 4/1996 | Carver . |
| 5,518,155 | 5/1996 | Gallagher . |

OTHER PUBLICATIONS

Gould & Goodrich, "Suggested Dealer Price List and Catalog Supplement," Effective Jan. 10, 1991.

Gould & Goodrich, "Finest Full Line of Holsters, Belts and Accessories," 1992, pp. 5 and 21.

*Primary Examiner*—Linda J. Sholl

[57] ABSTRACT

A retention device or clip for retaining a handgun trigger guard in a holster has a first end wall for securing against a rear end wall of the holster, a pair of flexible side walls projecting forwardly from the first end wall and a flexible third wall projecting forwardly from the first end wall at a location spaced below the side walls and extending at right angles to the side walls. Each side wall has a free end or ear biased inwardly towards the ear of the other side wall for extending into the trigger guard of a gun seated in the holster. The third wall acts as a rest for a lower edge portion of the trigger guard after it is pushed below the side walls, and also biases the trigger guard upwardly into engagement with the side walls for added security.

22 Claims, 3 Drawing Sheets

HOLSTER WITH TRIGGER GUARD RETENTION DEVICE

BACKGROUND OF THE INVENTION

The present invention relates generally to holsters for handguns, and is particularly concerned with retention devices for preventing handguns from accidentally falling out of holsters and also resisting unauthorized removal of handguns from holsters by persons other than the wearer of the holster.

Weapon retention for uniformed police officers has been a concern of holster designers for decades. It is very important for a police officer's security that an assailant cannot readily remove a handgun from the officer's holster. However, it is similarly important that the officer can readily draw the handgun from the holster when needed. Providing adequate security against unauthorized withdrawal while still permitting a quick draw of the handgun by the wearer of the holster has proved to be difficult to achieve, although numerous retention devices have been proposed in the past.

Because revolvers were the handguns of choice for American peace officers for more than 100 years until the 1980's, retention devices were generally designed to grip a revolver by its cylinder and/or trigger guard recurve. Some prior art devices were clips designed to grip the frame or cylinder of a pistol or revolver. One such device is described in U.S. Pat. No. 609,317 of Zimmerman, and a later device of this nature is described in U.S. Pat. No. 4,865,238 of Bianchi. Both of these devices are designed to grip the entire handgun.

In the 1970's, it became apparent that semi-automatic pistols were gaining favor in both police and civilian applications, and this required different designs for gripping devices. Initially, some holsters were provided with a bump or dent in the outer side wall to press into the trigger guard and thereby create friction.

In a large number of security holster designs, the holster has a full or partially open front or forward end wall, and the handgun is withdrawn by moving or pivoting it forwardly to release the gun from the retention device, which is normally designed to resist drawing of the gun straight upwardly out of the holster. Semi-front opening holsters are described in U.S. Pat. Nos. 3,942,692 of Chica and 4,542,841 of Nichols. Numerous trigger guard gripping devices have been designed for use in such holsters. Typically, such holsters are also equipped with a secondary retention device such as a security strap. These straps are typically used with fully or partially open front holsters and are arranged to pass around the front opening of the holster. The strap must be released before the handgun can be rotated forward to release from the trigger guard gripping device.

One such retention device designed for fully or partially open front holsters is described in U.S. Pat. No. 4,277,007 of Bianchi and Nichols. This holster has a spring loaded projection which extends into the trigger guard when a handgun is inserted in the holster. The projection prevents an upwards draw while permitting the handgun to be pulled forward to release the projection. Numerous other holsters have been designed in a similar manner. Another commercially successful holster of this type is described in U.S. Pat. No. 5,018,654 of Rogers, which also combines a trigger guard gripping device with a semi-front opening holster. The trigger guard gripping device in this case has two opposing bosses or barbed fins in the side walls of the holster which engage in the trigger guard. An elongated, rigid spacer is positioned below the fins to form a rest or stop for the trigger guard. The holster body is provided with voids into which the fins flex to permit the lower portion of the trigger guard to pass the fins or barbs. The fins then flex back out into the central opening of the trigger guard. Once the trigger guard is fully seated, the fins will resist upward drawing of the handgun.

Another similar retention device is provided in a Gould and Goodrich holster which has a spacer or "welt" inserted into the seam at the rear end wall of the holster. The spacer is made in two halves, each having a cantilever fin projecting from it to engage in a trigger guard when a handgun is inserted into the holster. Rivets project through the holster sidewalls and both halves of the spacer adjacent the fins. This is a bulky arrangement and may give rise to substantial stresses on the fixed fins. A later version of this holster had a separate spacer on which the pistol's trigger guard rests after insertion of the pistol into the holster. The retention device in this case is also made in two halves, with a fin for projecting into the trigger guard from each half, and has a narrow ledge on which the trigger guard rests. The rivets are spaced from the fins to allow the spacer to split open in a limited way at the fins, when the fins are being spread by passage of the trigger guard, thereby reducing strain on the cantilevered fins and reducing the risk of the fins breaking off. Both this device and the Rogers device rely on the holster side walls to complete the integrity of the device by encircling the split area.

In all of these prior art devices, the relationship between the trigger guard stop and the retention fins is critical. If there is too much space between the stop and the retention fins, the pistol can move around in the holster, which is undesirable and can cause wear on the pistol surfaces. When too little space is provided, the trigger guard of the pistol may fail to fully engage in the device, resulting in reduced weapon retention and thus reduced security. Since the spacing between the fins and the trigger guard stop or rest in such holsters may vary in production, it is difficult to ensure an optimum position of the fins relative to the trigger guard stop. If this optimum positioning is not achieved, the retention device may be of reduced effectiveness.

SUMMARY OF THE INVENTION

It is an object of the present invention to provide a new and improved trigger guard retention device for a holster.

According to one aspect of the present invention, a holster body is provided, having a handgun receiving cavity with an upper open end for receiving a handgun, a lower end, a forward end, and a rear end, and a trigger guard retention device is secured in the cavity in a position for receiving the trigger guard of a handgun inserted into the cavity. The retention device has a first end wall secured against the rear end of the cavity, a pair of flexible side walls projecting from opposite sides of the end wall, each side wall having a free end biased inwardly towards the free end of the other side wall, and a third wall projecting from the end wall at right angles to the pair of side walls and spaced from the side walls to leave a gap. The device has an open upper end to permit insertion of a trigger guard as the handgun is inserted downwardly into the cavity, whereby the free ends of the side walls first flex outwardly to permit passage of a lower portion of the trigger guard, and then flex inwardly to engage in the central opening of the trigger guard. The third wall provides a rest or stop for the lower end portion of the trigger guard which is located in the gap when the free ends of the side walls engage in the trigger guard, and is flexible so as to bias the trigger guard into engagement with the side walls, so that the device resists withdrawal of the handgun upwardly out of the cavity.

In a preferred embodiment of the invention, the retention device is a unitary structure formed in one piece, although the third end wall may be formed separately if desired. The one-piece structure has the advantage of allowing better control of the spacing between the trigger guard stop and the portion of the retention device which extends into the trigger guard, and also is simpler in construction and simpler to attach to the holster.

The flexibility of the third wall has a number of advantages. Firstly, the spacing between the side walls and third wall is less critical, since the spacing will be self-adjusting due to the flexibility of the third wall. The flexibility of the third wall also biases the trigger guard against the gripping side walls for better retention and resistance of movement of the handgun. The third wall is also able to deflect in order to enable a smooth withdrawal of the handgun when it is urged forwardly to release the trigger guard. This is important since the majority of trigger guards are designed with a hook or protuberance on the lower end portion of the trigger guard when oriented for insertion in a holster.

According to another aspect of the present invention, a trigger guard retention device for a handgun holster is provided, which comprises a first end wall for securing to an end wall of a handgun holster in a predetermined position so that the device receives a trigger guard of a handgun inserted into the holster, a pair of flexible side walls projecting forwardly from the end wall, each side wall having a free end biased inwardly towards the free end of the opposite side wall for engagement in a trigger guard opening when the trigger guard is seated in the device, and a third wall projecting from the end wall at right angles to the side walls and positioned to form a stop for a lower end portion of a trigger guard when the free ends of the side walls engage in the trigger guard opening. The third wall is flexible and acts to bias the trigger guard into engagement with the side walls, while deflecting to permit release of the trigger guard from the retention device.

The device is preferably of one-piece construction for simplicity and optimum control of the spacing between the gripping side walls and the third end wall. It may be injection molded in one piece from a suitable strength plastic material which has sufficient strength to retain the trigger guard against upward pulls but has sufficient flexibility to release the trigger guard if the handgun is pulled forwardly. The device operates independently of the holster side walls, unlike prior art arrangements which require cooperation with the holster side walls for proper operation.

The gripping or retention device of the invention is simple and inexpensive, yet provides substantial retention of a handgun against pulling up out of the holster. The holster wearer can readily draw the handgun by pulling forwards, simultaneously deflecting the lower end wall of the device to allow the trigger guard to be released from the side walls. The preferred unitary construction provides greater strength and resistance against breakage. The device can be readily installed in any type of holster, including holsters with a rigid spine.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
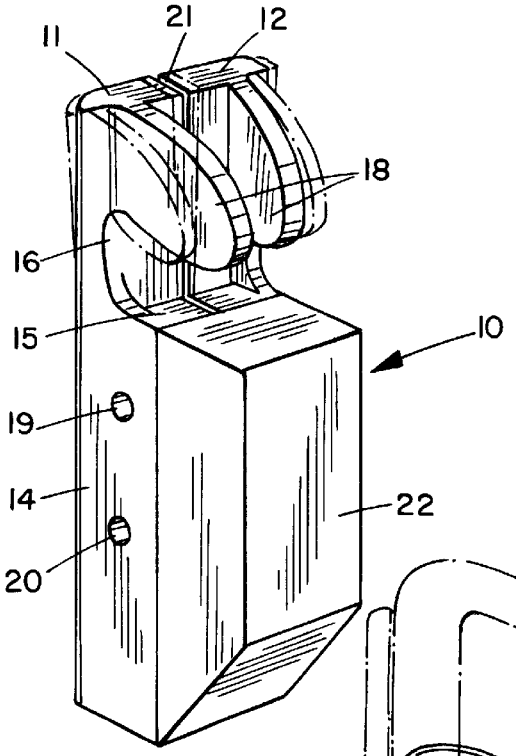
FIG. 1 PRIOR ART
FIG. 1 is a pictorial view of a prior art split type gripper.
Figure 1A:
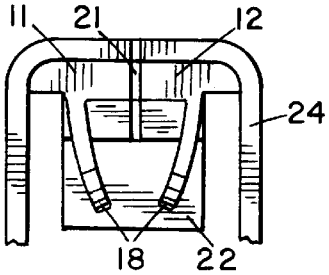
FIG. 1A PRIOR ART
FIG. 1A is a top plan view of the gripper of FIG. 1, with a portion of a holster added for reference.

FIGS. 1 and 1A illustrate a prior art trigger guard gripper device 10 as made by Gould & Goodrich of Lillington, N.C. The device 10 is made in two halves 11,12, each of which has an elongate block or spacer portion 14 extending from its lower end, terminating in step or ledge 15, and a recessed upper portion 16 from which a flexible fin 18 projects for engagement in a trigger guard. The two halves 11,12 are secured together in a rear end wall of a holster 24 by bolts or the like projecting through the holster side walls and openings 19,20 extending transversely through the lower spacer portions 14 of the two halves. This allows the upper portions 16 to flex outwardly to some extent, as indicated by the dotted lines in FIG. 1.

When a pistol is inserted in the holster, the trigger guard first forces the fins 18 apart, sufficiently to allow a lower portion of the guard to pass between the fins. The fins then flex back inwardly into the central opening of the guard, while the lower portion rests against the rigid step or ledge 15. An extension block 22 is sometimes secured to the device to act as a fulcrum for the muzzle of a pistol when drawing the pistol from the holster.

The gripper device 10 relies on the free play provided by the split 21 in the upper end portion to reduce strain at the root of the fins as they are forced apart. The movement of the fins also has a torsion and cantilever effect, tending to rotate the split end walls as indicated in dotted outline in FIG. 1. This increases stress. The relationship of the fins to the rigid stop or ledge is critical in ensuring proper operation. This device also relies on the holster sidewalls to complete the integrity of the device by encircling the split area. Since a large number of handguns have trigger guards with a hooked end or protuberance, which will rest against ledge 15 of the device of FIG. 1, there is a problem when the holster wearer attempts to draw the handgun. The hooked end or protuberance slides against the rigid surface of ledge 22, and may even drag or cut into this surface, preventing smooth drawing of the handgun.

Figure 2:
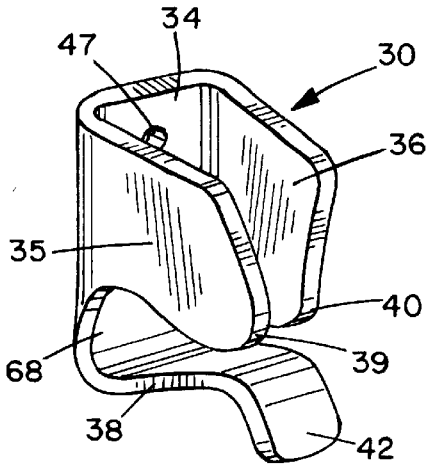
FIG. 2 is a pictorial view of a unitary gripper or trigger guard retaining clip according to a first embodiment of the present invention.
Figure 3:
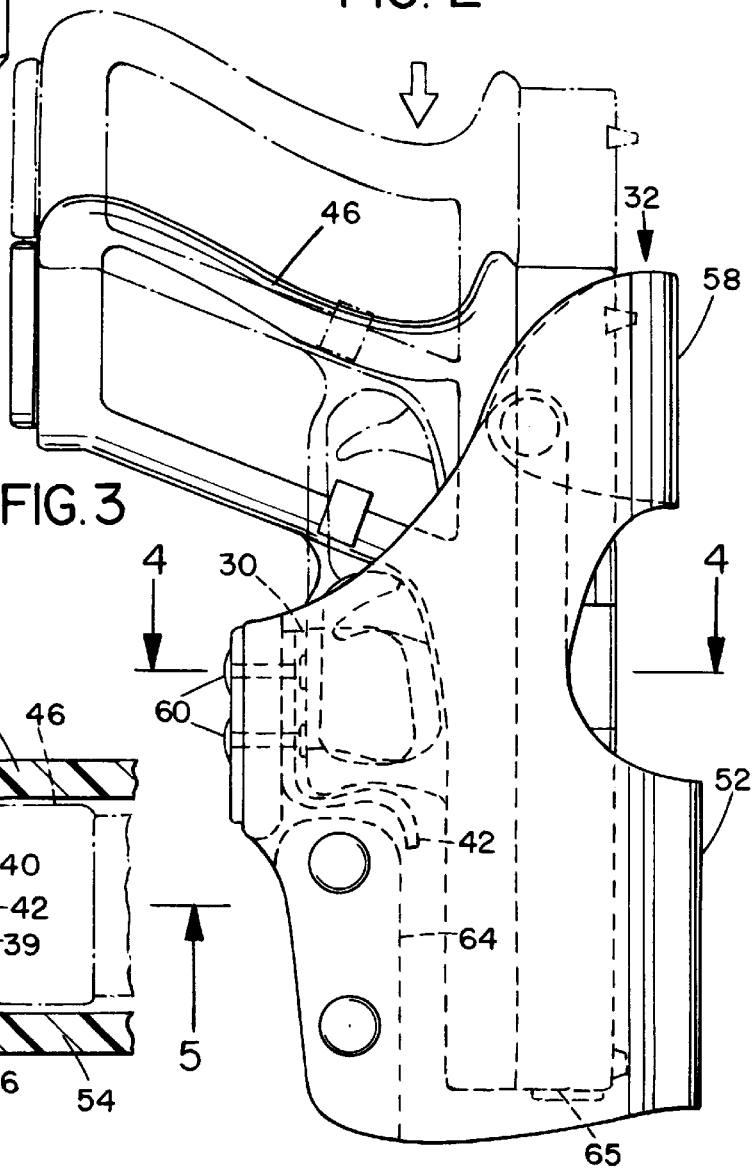
FIG. 3 is a side elevation view of a typical holster incorporating the gripper clip, showing a pistol secured in place.
Figure 4:
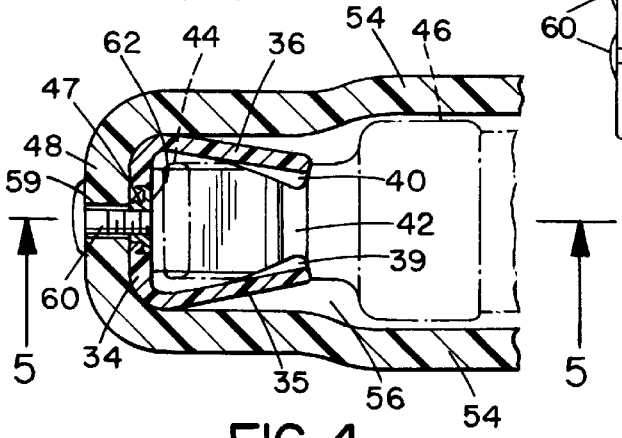
FIG. 4 is an enlarged sectional view taken on line 4—4 of FIG. 3.
Figure 5:
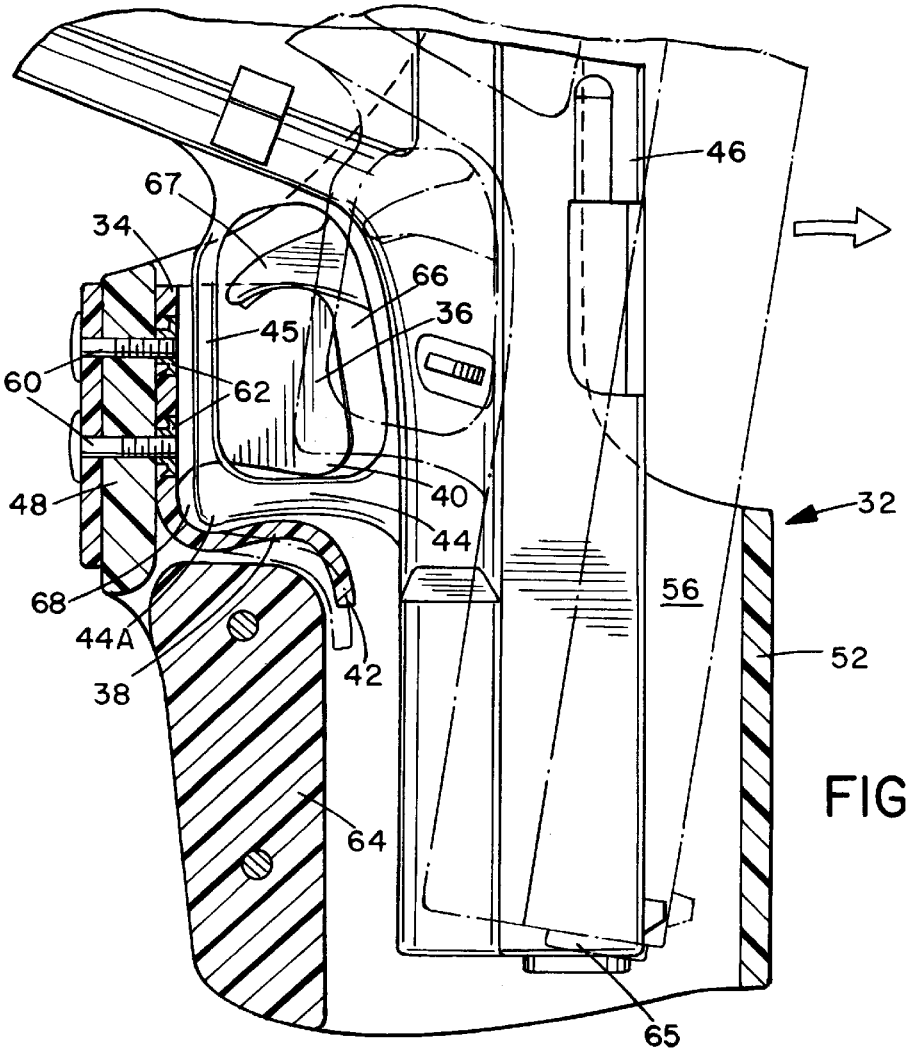
FIG. 5 is a sectional view taken on line 5—5 of FIG. 4, with the pistol secured, the releasing action of the pistol being indicated in broken line.

FIG. 2 illustrates a gripper clip or trigger guard retention device 30 according to a first embodiment of the present invention, while FIGS. 3–5 illustrate the clip 30 in use and mounted in a holster 32 to retain a pistol 46. Although the device illustrated in FIGS. 3–5 is used for retaining a pistol, it will be understood that it may also be used for retaining revolvers and other types of handguns.

The clip or device 30 is preferably formed in one piece as illustrated, and basically comprises a first or rear end wall 34, a pair of side walls or fins 35,36 projecting outwardly from opposite sides of end wall 34, and a lower end wall 38 spaced below the side walls and projecting from a lower edge of end wall 34 in a direction generally perpendicular to the side walls. The walls together define a chamber or channel for receiving a trigger guard. Both the side walls 35,36 and the lower end wall are flexible in the preferred embodiment, although it may not be necessary for the lower end wall to be flexible in all embodiments. As best illustrated in FIGS. 2 and 4, the side walls 35,36 are inclined inwardly towards one another in a first direction away from the rear end wall, and are also tilted inwardly in a downwards direction towards the lower end wall, so that the lower edges or free ends 39,40 of the side walls form ears and the spacing between ears 39,40 is less than that along the remainder of the height of each side wall. The spacing between the ears 39,40 at the lower end of each side wall may be equal to one half or less the spacing between the upper ends of the side walls. Thus, a gap of gradually tapering width is formed between the two side walls from the upper to the lower end of the device. In one example the gap tapered from a maximum of around 0.60" to a minimum of 0.125", although these parameters may vary dependent on the size of trigger guard to be retained.

The lower end wall 38 is curved upwardly towards the side walls and then back downwardly to form a downwardly directed lip 42 at its free end, as best illustrated in FIGS. 2 and 5. This shape generally conforms to the shape of a lower end edge 44 of a typical trigger guard 45 of a pistol or handgun 46, as indicated in FIG. 5. The rear end wall 34 of the device is provided with a pair of recessed openings 47 by means of which the device may be secured to a rear end wall 48 of holster 32, as will be described in more detail below.

The device may be formed from any suitable material of sufficient strength and flexibility. Preferably, the device 30 is injection molded in one piece from plastic material such as engineering polymer of sufficient stiffness and flex modulus, for example a polyamide such as nylon 6/6 or acetal such as DELRIN®. Alternatively, the device may be made by folding a suitably shaped flat blank of material into the shape illustrated in FIG. 2 or by machining from a solid block of flexible polymer. The device has a smooth inner surface to reduce the risk of abrasion to the trigger guard on repeated insertion and removal.

The retention device or clip 30 may be secured to the rear end wall of any selected holster using any suitable fastener mechanism. In FIGS. 3–5, the clip 30 is secured in the rear end wall 48 of a holster 32 of the type having a partially open front end 52. However, it will be understood that clip 30 may alternatively be secured in other types of forward draw or front opening holsters. A pair of spaced sides 54 extend between the front and rear end walls of the holster 32 to define an inner cavity 56 for receiving and holding handgun or pistol 32. The holster has an open upper end into which the pistol 46 is inserted downwardly to engage in the holster. A releasable strap 58 extends around the upper portion of the holstered handgun for added security, as indicated in FIG. 3.

The holster has an at least partially closed rear end wall, which is preferably formed by a fold in at least part of a holster blank, as in the embodiment illustrated in FIGS. 3–5. The rear end wall 34 of the clip is placed against the inside surface of the rear end wall of the holster at an appropriate position for receiving the trigger guard 45 of the handgun or pistol when fully seated in the holster. Openings 59 in the rear end wall of the holster are aligned with openings 47 in this position, and the device is secured in position via fastener screws 60 extending through the aligned openings and locked in place by means of tee-nuts 62, as best illustrated in FIG. 4. The tee nuts 62 are preferably recessed into the openings 47 or covered to prevent scratching of the trigger guard 45. Although two fastener screws are used in the illustrated embodiment, one may be sufficient in some cases. The device may alternatively be secured to the holster using other fastener devices such as rivets.

Preferably, a spacer or welt 64 is provided in the rear end wall of the holster beneath the clip or retention device 30, as illustrated in FIGS. 3 and 5. The spacer 64 may be formed integrally with the rear end wall of the holster, or a separate spacer block may be secured between the holster side walls using rivets, bolts, screws or the like, as illustrated. Alternatively, the spacer may be formed integrally with clip device 30. The spacer acts as a fulcrum for the pistol's muzzle 65 to facilitate drawing of the gun from the holster. In the prior art, the positioning of such a spacer relative to a trigger guard retention device was critical in ensuring proper operation of the retention device while permitting the gun to be drawn. However, with the retention device of this invention, the spacing between spacer or welt 64 and the retention device 30 is not critical, as will be explained in more detail below.

The trigger guard 45 forms a bow or ring defining a protected opening 66 in which the pistol actuating trigger 67 is located. The lower end edge 44 of the trigger guard will be the first portion to enter the device 30 when a handgun is inserted downwardly into the holster in the direction of the arrow in FIG. 3. The lower end portion 44 of the trigger guard will slide into the clip or retention device 30 between the side walls 35,36. The spacing between the ears 39,40 at the lower end of the side walls is less than the thickness of the lower end portion of the trigger guard, so that the ears are flexed away from one another to allow the lower end portion to pass between them. The unitary or one-piece construction helps to spread the force or stress around the rear end wall 34, so that there will be much less stress at the root of each side wall where it meets end wall 34, and therefore much less risk of the side wall or fin breaking off after repeated use.

Once the lower end portion 44 of the trigger guard moves below the free ends or ears 39,40, they will spring or snap back towards one another to engage in opening 66 above portion 44, which is then located in the space 68 between the lower edges of the side walls and the lower end wall 38 of the device, as best illustrated in FIG. 5. At this point, the retention device is encircling the bow of the trigger guard to retain it in its seated position. The upwardly curved portion of the lower end wall bears against portion 44, resiliently biasing the trigger guard firmly into engagement with the side walls. This helps to hold the trigger guard in position and resists rocking or movement of the gun in the holster.

The side walls are shaped such that a trigger guard can be inserted downwardly into the device, but cannot be pulled back upwardly out of the device. Instead, the trigger guard can only be released by pivoting forwardly, as indicated by the arrow in FIG. 5. Since the side walls are tapered inwardly towards one another in a downwards direction, the ears 39,40 at their lower edges act in the manner of a barb, in that they permit the trigger guard to be inserted downwardly into the device, but resist upward movement out of the device when the ears are engaged in the opening 66. The side walls are also tapered inwardly towards one another in a forwards direction from the rear wall, as illustrated in FIG. 4.

In order to release the trigger guard, the handgun must first be pulled directly forward for a sufficient distance to clear the side walls, which are forced apart to release the trigger guard. The handgun can then be pivoted as indicated in dotted outline in FIG. 5. The protuberance or hook 44A will not catch on the lower end wall 38, unlike prior art arrangements, since wall 38 will simply flex out of the way as the handgun is pulled forward.

Thus, when a handgun is inserted in holster 32 until the trigger guard is fully engaged in the retention device or gripping clip 30 as illustrated in solid outline in FIG. 5, the clip will act to hold the handgun in position and resist pulling of the handgun in an upwards direction out of the holster. This provides added safety for security personnel or police officers against assailants who may attempt to remove the gun. When the holster wearer wishes to draw the gun from the holster, they simply pivot the gun forwardly in the direction of the arrow of FIG. 5. The trigger guard will then urge the side walls apart until the trigger guard is clear of the ears and is released, in the dotted line position of FIG. 5. During this movement, the lower end wall 38 of the device will flex downwardly to permit a smooth release motion, allowing the hooked end 44A of the guard to release. This contrasts with prior art devices using a rigid stop member, which could prevent smooth withdrawal of the gun. The spacer 64 preferably provides a stop against overflexing of wall 38, and will limit the amount of flex as indicated in dotted outline in FIG. 5. However, the stopping action of the spacer is not essential, and it may operate only as a fulcrum for levering the muzzle of the gun, or be present only as a filler in some cases.

The use of a flexible end wall 38 also permits the device to be used with several different types of pistols or handguns and several different trigger guard profiles, since the end wall will flex to accommodate lower end portions 44 of different shapes and dimensions. It also allows for variance in trigger guard dimensions in a single type of handgun. This adaptability reduces the amount of tooling required to manufacture the devices, and reduces the number of different parts which must be designed, tested, manufactured, and inventoried. The flexibility of end wall 38 therefore provides a self-adjusting gap between the end wall 38 and the gripping side walls.

Figure 6:
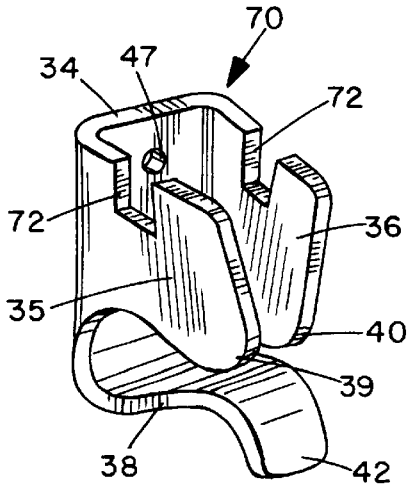
FIG. 6 is a pictorial view of a modified gripper clip.
Figure 7:
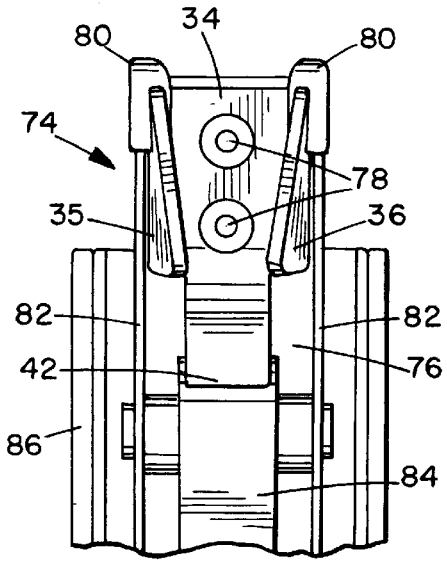
FIG. 7 is a front view of the modified clip installed in a spine member for insertion in a holster.
Figure 8:
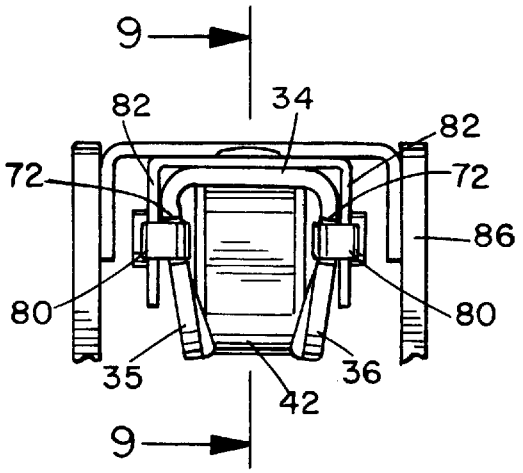
FIG. 8 is a top plan view of the structure of FIG. 7.
Figure 9:
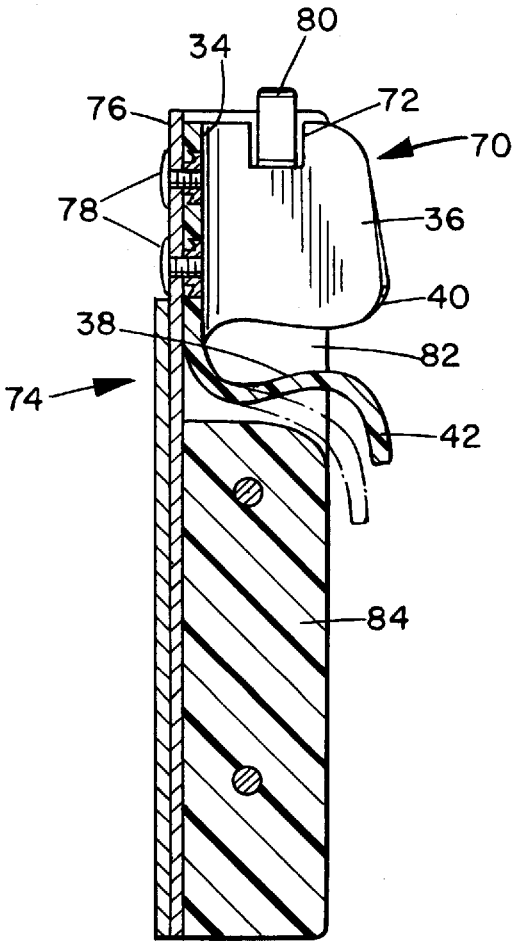
FIG. 9 is a sectional view taken on line 9—9 of FIG. 8.

FIG. 6 illustrates a modified clip or retention device 70 which is identical to that of FIGS. 2–5 apart from the provision of a pair of notches 72 in the upper edge of the respective side walls. Since the device 70 is otherwise identical to that of the first embodiment, like reference numerals have been used for like parts as appropriate. The device 70 is particularly adapted for mounting in holsters having a rigid spine 74 forming the rear end wall, which is attached to side walls 86, as illustrated in FIGS. 7–9, for example the holster as described in my U.S. Pat. No. 5,570,830, the contents of which are incorporated herein by reference. The device is simply mounted in the channel formed by the spine and secured against the end wall 76 of the spine by fastener screws 78 or the like, as in the previous embodiment. Preferably, the spine is provided with lugs or hook members 80 at the upper end of each side wall 82, which are received in the respective notches 72 for added strength. The lugs may be formed integrally with the spine, or may be formed separately and suitably secured to the side walls. The lower end wall 38 of the device 70 will be positioned above the upper end of spacer member 84 which is secured in the spine below the device.

The mounting of the device 70 in the rigid spine 74 using lugs engaging in notches in the side walls provides added strength and additional security against unauthorized withdrawal of a handgun from the holster. The lugs 80 act as stops to prevent any upward flexing of side walls 35,36 if an assailant attempts to pull the handgun upwardly out of the holster.

As noted above, the gripper or retention device 30 or 70 may be mounted in any type of holster, with or without a spacer or welt positioned below the device as in FIGS. 5 and 7. However, the use of a holster with a spacer or welt positioned below the lower end wall of the device does have advantages. One advantage is the action of the spacer in providing a stop for the muzzle of the gun facilitating leverage of the gun forwardly to permit the gun to be drawn. Another advantage is that the spacer may be arranged to limit the amount of flex of the lower end wall of the device 30 or 70, reducing the risk of breakage due to overflexing. This increases the potential lifetime of the device. The exact position of the spacer relative to the clip or retention device is not as critical as in the prior art, since it does not index the trigger guard relative to the retention fins. If desired, the spacer may be formed integrally with the clip device, simplifying manufacture. An integral spacer can also add strength to the assembled device and holster, when the fasteners passing into or through the spacer and holster walls also act to further retain the device inside the holster.

In the above embodiments, the clip or retention device is of one-piece or unitary construction, so that the end wall 34, side walls 35,36, and lower end wall 38, are formed integrally, for example by injection molding or the like. This is the preferred method of construction, due to its simplicity and also the consistency of the gap or spacing 68 between the lower end wall and side walls for indexing of the trigger guard. The gap is variable due to the flexibility of the lower end wall, so that trigger guards of different profile and dimensions can be retained. However, maintaining a degree of consistency in the size of this gap when the lower end wall is unflexed is still desirable. This invention also allows for variance in trigger guard dimensions in a single pistol model, which is a common occurrence and has proved to be a problem in prior art trigger guard retention devices.

Although the one-piece construction is preferable, as noted above, the lower end wall or third wall may be a separate member from the remainder of the clip if desired. In this case, the third wall is preferably attached to the remainder of the clip or designed such that the spacing between the parts is controlled in some way, even if the parts are not formed as a unitary piece. Thus, the third end wall may be secured to the holster rear end wall or may be part of the spacer.

Another possible alternative would be to make the rear end wall and third wall of the clip in one piece, with the side walls formed separately and suitably secured to the rear end wall or to the holster. This would allow for adjustment of the spacing between the side walls and third wall.

Since the side walls are formed in one piece with the end wall 34, they flex together as a unit and stress is spread across the connecting wall. This reduces the risk of excessive stress causing the side walls to break off at the root or base.

The clip or retention device is readily attachable to holsters having a folded rear end wall or holsters having spines forming the rear end wall. The provision of a flexible third wall or lower end wall has a number of advantages, as discussed above. This allows the clip to retain different types of guns with trigger guards of varying profiles and dimensions, reducing inventory requirements, and also acts to bias the trigger guard against the side walls for better retention. Further, the resilient third wall can flex to allow smoother withdrawal of the handgun from the holster. The clip or retention device provides positive retention of a pistol or other type of handgun against withdrawal by an assailant, while still permitting a smooth draw by the holster wearer. The clip device requires more forward motion of the handgun to release the trigger guard than was necessary in prior art arrangements, providing more security.

Although some preferred embodiments of the invention have been described above by way of example only, it will be understood by those skilled in the field that modifications may be made to the disclosed embodiments without departing from the scope of the invention, which is defined by the appended claims.

I claim:

1. A handgun holster, comprising:

a holster body having a handgun receiving cavity with an upper open end for receiving a handgun, a lower end, a forward end, and a rear end;

a trigger guard retention device for receiving the trigger guard of a handgun inserted in the cavity, the device having a first end wall secured against the rear end of said cavity, the first end wall having opposite sides, a pair of flexible side walls projecting forwardly from the respective opposite sides of said end wall, each side wall having a free end biased inwardly towards the free end of the other side wall for projecting into a trigger guard of a handgun inserted in the cavity, and a third wall projecting forwardly from the end wall at right angles to the pair of side walls with a space between the side walls and third wall, the third wall being flexible; and said third wall comprising a rest for the lower end portion of the trigger guard when the free ends of the side walls project into the trigger guard, and further comprising biasing means for biasing said trigger guard into engagement with said side walls, whereby said retention device resists withdrawal of the handgun from said cavity.

2. The holster as claimed in claim 1, including a spacer member at the rear end of said cavity at a location spaced below said third wall of said retention device.

3. The holster as claimed in claim 1, wherein at least the side walls of said retention device are formed integrally with said first end wall.

4. The holster as claimed in claim 3, wherein the side walls and third wall are formed integrally with said first end wall to provide a one-piece retention device.

5. The holster as claimed in claim 1, wherein the first end wall of the retention device has at least one opening and the rear end of said holster has an opening aligned with said one opening, and a fastener member extends through said aligned openings to secure the retention device at a predetermined position in said cavity.

6. The holster as claimed in claim 1, wherein the retention device has an upper open end for receiving the trigger guard of a handgun inserted downwardly into said holster, and said side walls taper inwardly from the upper end towards the third wall to define a spacing of gradually reducing width between said side walls.

7. The holster as claimed in claim 6, wherein said side walls taper inwardly from the first end wall towards the forward end of said holster, whereby the side walls define a chamber of gradually reducing width in two directions.

8. The holster as claimed in claim 1, wherein the third wall bends upwardly towards the free ends of said side walls in a direction extending from said first end wall.

9. The holster as claimed in claim 8, wherein the third wall has a free end bent downwardly away from the free ends of said side walls.

10. The holster as claimed in claim 1, wherein the holster body is formed from a piece of material having a fold defining said rear end, and the first end wall of said retention device is secured to said fold.

11. The holster as claimed in claim 1, wherein the holster body comprises an elongate, rigid spine having a central channel and forming the rear end of said cavity, and a separate holster body member forming said forward end and opposite sides of said cavity, the opposite sides of said body member being secured to opposite sides of said spine, and said retention device being secured in said channel.

12. The holster as claimed in claim 11, wherein the side walls have upper edges, each upper edge having a notch, and the channel has a lug on each side projecting into the channel and engaging in a notch in a respective side wall of said retention device.

13. A trigger guard retention device for a handgun holster, comprising:

a first end wall for securing to an end wall of a handgun holster;

a pair of flexible side walls projecting from the end wall to form a channel for receiving the trigger guard of a handgun inserted into the holster, the channel having an upper end, a lower end, and a forward open end, and each side wall having a free end biased inwardly towards the free end of the opposite side wall and comprising means for engagement in a trigger guard opening;

each side wall having an upper end having a notch; and a third wall spaced below the lower end of the channel and projecting at right angles to the side walls to form a stop for a lower end portion of a trigger guard when the free ends of the side walls engage in the trigger guard opening, the third-wall being flexible and comprising means for biasing the trigger guard into engagement with the side walls, said third wall being deflectable to permit release of said trigger guard from said retention device.

14. The device as claimed in claim 13, wherein at least the side walls are formed integrally with said first end wall.

15. The device as claimed in claim 14, wherein the side walls and third wall are formed integrally with said first end wall to form a unitary device.

16. The device as claimed in claim 13, wherein the first end wall has at least one opening for receiving a fastener for securing the device to an end wall of a holster.

17. The device as claimed in claim 13, wherein each side wall is tapered inwardly in a direction from the first end wall to the forward end of the channel to form a channel of gradually tapering width in cross-section.

18. The device as claimed in claim 17, wherein each side wall is tapered inwardly from the upper end to the lower end of the channel and the forward end of the channel is of correspondingly tapering width towards the lower end of the channel.

19. The device as claimed in claim 17, wherein the free ends of the side walls comprise ears having a rounded periphery formed at the lower end of the channel.

20. The device as claimed in claim 13, wherein said walls each have a smooth inner surface.

21. The device as claimed in claim 13, wherein the third wall bends upwardly towards the free ends of said side walls in a direction away from said first end wall.

22. The device as claimed in claim 21, wherein the third wall has a free end bent downwardly away from said side walls.

* * * * *